US011577363B2

(12) United States Patent
Fukushi

(10) Patent No.: US 11,577,363 B2
(45) Date of Patent: Feb. 14, 2023

(54) GRINDING METHOD OF BONDED WORKPIECE OBTAINED BY BONDING TRANSPARENT COMPONENTS OR SEMITRANSPARENT COMPONENTS TO EACH OTHER

(71) Applicant: DISCO CORPORATION, Tokyo (JP)

(72) Inventor: Nobuyuki Fukushi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 191 days.

(21) Appl. No.: 17/243,839

(22) Filed: Apr. 29, 2021

(65) Prior Publication Data

US 2021/0370465 A1 Dec. 2, 2021

(30) Foreign Application Priority Data

May 26, 2020 (JP) ..... JP2020-091289

(51) Int. Cl.
*B24B 49/12* (2006.01)
*B24B 7/22* (2006.01)
*B24B 41/06* (2012.01)

(52) U.S. Cl.
CPC ..... *B24B 49/12* (2013.01); *B24B 7/228* (2013.01); *B24B 41/06* (2013.01)

(58) Field of Classification Search
CPC ..... B24B 49/12; B24B 7/228; B24B 41/06; B24B 41/005; B24B 41/02; B24B 41/042; B24B 1/00; B24B 51/00; B24B 13/005; B24B 5/18; B24B 5/28; B24B 37/04; B24B 37/07; B24B 37/10; B24B 37/107; B24B 37/005; B24B 37/34; B24B 37/345; B24B 27/0069; H01L 21/67092
USPC ..... 451/5
See application file for complete search history.

(56) References Cited

U.S. PATENT DOCUMENTS

2004/0067621 A1* 4/2004 Yanagita ..... H01L 21/67092 438/455
2018/0093361 A1* 4/2018 Yamanaka ..... B24B 37/34
2019/0308399 A1* 10/2019 Mori ..... C09J 5/00

FOREIGN PATENT DOCUMENTS

JP 2009123790 A * 6/2009 ..... B24B 47/22
JP 2009123790 A 6/2009
JP 2014060224 A * 4/2014 ..... B23K 2103/50

* cited by examiner

*Primary Examiner* — Joel D Crandall
*Assistant Examiner* — Michael A Gump
(74) *Attorney, Agent, or Firm* — Greer Burns & Crain Ltd.

(57) ABSTRACT

A grinding method includes a step of imaging a bonded workpiece by a camera in such a manner as to include the outer circumference of a workpiece and the outer circumference of a support component with a larger diameter than that of the workpiece before a step of holding the support component of the bonded workpiece by a holding surface. The grinding method also includes a step of recognizing the outer circumference of the support component and the outer circumference of the workpiece on the basis of the brightness difference between pixels adjacent to each other in a taken image and a step of recognizing the center of the support component from the recognized outer circumference of the support component and recognizing the center of the workpiece from the recognized outer circumference of the workpiece.

5 Claims, 5 Drawing Sheets

GRINDING METHOD OF BONDED WORKPIECE OBTAINED BY BONDING TRANSPARENT COMPONENTS OR SEMITRANSPARENT COMPONENTS TO EACH OTHER

BACKGROUND OF THE INVENTION

Field of the Invention

The present invention relates to a grinding method of a bonded workpiece obtained by bonding two transparent components or semitransparent components to each other and a grinding apparatus of the bonded workpiece.

Description of the Related Art

As disclosed in Japanese Patent Laid-open No. 2009-123790, for example, a grinding apparatus that grinds a workpiece such as a semiconductor wafer by an abrasive stone detects the outer circumference of the workpiece and recognizes the center of the workpiece on the basis of the detected outer circumference before the workpiece with one surface to which a tape is stuck is carried into a chuck table. Then, the grinding apparatus causes the center of a holding surface to correspond with the center of the workpiece, causes the holding surface to hold the workpiece, and grinds the workpiece by the abrasive stone.

In grinding lithium tantalate ($LiTaO_3$) of a transparent component or semitransparent component that is a workpiece by an abrasive stone, there is a problem that thinned lithium tantalate bends and breaks if a tape is stuck to one surface of the lithium tantalate and the lithium tantalate is ground in the state in which the side of the one surface is held. Thus, in order to prevent the thinned lithium tantalate from bending, the lithium tantalate is bonded to a substrate (support component) of a hard material such as transparent or semitransparent glass instead of the tape, and the lithium tantalate is ground with the substrate side held.

SUMMARY OF THE INVENTION

In a bonded workpiece obtained by bonding a support component and lithium tantalate to each other, the center of the support component slightly deviates from the center of the lithium tantalate. Thus, the lithium tantalate has a smaller diameter than that of the support component in order to prevent the lithium tantalate from protruding from the support component even when they are bonded to each other with the centers thereof slightly deviating from each other.

Further, in order to reduce thickness difference of the lithium tantalate thinned by grinding, a notch or orientation flat indicating the crystal orientation is not formed at the outer circumference of the lithium tantalate, and a mark indicating the crystal orientation is formed in the support component. In addition, the center of the lithium tantalate is caused to correspond with the center of a holding surface, and the holding surface is caused to hold the bonded workpiece. The lithium tantalate is then ground by an abrasive stone and is thinned. That is, the center of the holding surface does not correspond with the center of the support component at the time of grinding, in some cases. Further, the support component is larger than the holding surface in order to allow the holding surface to be covered by the support component for preventing a vacuum leak.

The support component in the case in which a mark indicating the crystal orientation is formed in the lithium tantalate may be slightly larger than the holding surface, and, in grinding, the holding surface may be caused to hold the bonded workpiece with the center of the support component caused to correspond with the center of the holding surface.

Thus, an object of the present invention is to provide a grinding method and a grinding apparatus that enable selective switching between the case in which the center of a support component is caused to correspond with the center of a holding surface of a chuck table and the case in which the center of lithium tantalate that is a workpiece is caused to correspond with the center of the holding surface, when causing the holding surface to hold a bonded workpiece obtained by bonding two transparent components or semitransparent components to each other.

In accordance with an aspect of the present invention, there is provided a grinding method of a bonded workpiece for grinding a workpiece of the bonded workpiece by an abrasive stone. The bonded workpiece is obtained by bonding at least two transparent components or semitransparent components including the workpiece and a support component to each other. The workpiece is a circular plate and is transparent or semitransparent. The support component is a circular plate with such a size as to protrude from the outer circumference of the workpiece to the outside and is transparent or semitransparent. The grinding method includes an imaging step of imaging the bonded workpiece by a camera in such a manner as to include the outer circumference of the workpiece and the outer circumference of the support component and an outer circumference recognition step of recognizing each of the outer circumference of the support component and the outer circumference of the workpiece on the basis of the brightness difference between pixels adjacent to each other in a taken image obtained by imaging the bonded workpiece in the imaging step. The grinding method also includes a center recognition step of recognizing the center of the support component from the outer circumference of the support component recognized in the outer circumference recognition step and recognizing the center of the workpiece from the outer circumference of the workpiece recognized in the outer circumference recognition step, a holding step of causing a holding surface of a chuck table to hold the support component of the bonded workpiece after executing the center recognition step, and a grinding step of grinding, by the abrasive stone, the workpiece of the bonded workpiece held in the holding step. The workpiece is ground in the grinding step after one of a case in which the holding surface is caused to hold the support component in such a manner that the center of the holding surface is caused to correspond with the center of the support component and a case in which the holding surface is caused to hold the support component in such a manner that the center of the holding surface is caused to correspond with the center of the workpiece is selectively executed in the holding step.

Preferably, the imaging step includes a temporary placement step of temporarily placing the bonded workpiece on a temporary placement table in such a manner that the outer circumference of the workpiece and the outer circumference of the support component are protruded from the temporary placement table. Further, in the imaging step, light is emitted from the lower side of the bonded workpiece to the upper side by an illuminator disposed below the bonded workpiece temporarily placed on the temporary placement table, and the bonded workpiece is imaged in such a manner as to include the outer circumference of the workpiece and the outer circumference of the support component, by the camera disposed to face the illuminator.

Preferably, in the imaging step, the bonded workpiece is imaged by the camera in such a manner as to include the outer circumference of the workpiece and the outer circumference of the support component in the bonded workpiece held by a conveying unit that conveys the bonded workpiece to the holding surface.

In accordance with another aspect of the present invention, there is provided a grinding apparatus including a chuck table that holds a support component of a bonded workpiece by a holding surface. The bonded workpiece is obtained by bonding at least two transparent components or semitransparent components including a workpiece and the support component to each other. The workpiece is a circular plate and is transparent or semitransparent. The support component is a circular plate with such a size as to protrude from the outer circumference of the workpiece to the outside and is transparent or semitransparent. The grinding apparatus also includes a grinding unit that grinds, by an abrasive stone, the workpiece of the bonded workpiece held by the holding surface, a conveying unit that conveys the bonded workpiece to the holding surface of the chuck table to cause the holding surface to hold the bonded workpiece, a camera that images the bonded workpiece, and a control unit that controls at least the chuck table, the grinding unit, the conveying unit, and the camera. The control unit includes an outer circumference recognizing section that, before the bonded workpiece is held by the holding surface of the chuck table, distinguishes between the outer circumference of the workpiece and the outer circumference of the support component and recognizes the outer circumferences from a taken image of the bonded workpiece in which the outer circumference of the workpiece and the outer circumference of the support component are included. The control unit also includes a center recognizing section that recognizes the center of the support component from the outer circumference of the support component recognized by the outer circumference recognizing section and recognizes the center of the workpiece from the outer circumference of the workpiece recognized by the outer circumference recognizing section. The control unit also includes a setting section that sets whether the center of the holding surface is caused to correspond with the center of the support component or the center of the holding surface is caused to correspond with the center of the workpiece when the holding surface of the chuck table is caused to hold the bonded workpiece. The control unit controls the conveying unit in order to cause the holding surface of the chuck table to hold the bonded workpiece according to setting of the setting section.

Preferably, the support component has a mark indicating the crystal orientation of the workpiece, and the holding surface of the chuck table has the same shape as the support component in plan view. Further, the chuck table includes a holding surface rotation unit that rotates the holding surface with the center of the holding surface being the axis, and the control unit controls the holding surface rotation unit and causes the mark of the support component of the bonded workpiece held by the conveying unit to match a corresponding mark that is formed in the holding surface and corresponds to the mark.

According to the grinding method of the present invention, one of the case in which the holding surface is caused to hold the support component in such a manner that the center of the holding surface is caused to correspond with the center of the support component and the case in which the holding surface is caused to hold the support component in such a manner that the center of the holding surface is caused to correspond with the center of the workpiece can selectively be executed in the holding step, and thereafter, the workpiece can be ground in the grinding step.

The imaging step includes the temporary placement step of temporarily placing the bonded workpiece on the temporary placement table in such a manner that the outer circumference of the workpiece and the outer circumference of the support component are protruded from the temporary placement table. In the imaging step, light is emitted from the lower side of the bonded workpiece to the upper side by the illuminator disposed below the bonded workpiece that is temporarily placed on the temporary placement table, and the bonded workpiece is imaged in such a manner as to include the outer circumference of the workpiece and the outer circumference of the support component, by the camera disposed to face the illuminator. Therefore, the taken image necessary in the outer circumference recognition step to be executed after the imaging step can easily be acquired.

In the imaging step, the bonded workpiece is imaged by the camera in such a manner as to include the outer circumference of the workpiece and the outer circumference of the support component in the bonded workpiece held by the conveying unit that conveys the bonded workpiece to the holding surface. Therefore, the taken image necessary in the outer circumference recognition step to be executed after the imaging step can easily be acquired.

According to the grinding apparatus of the present invention, one of the case in which the holding surface is caused to hold the bonded workpiece in such a manner that the center of the holding surface is caused to correspond with the center of the support component and the case in which the holding surface is caused to hold the bonded workpiece in such a manner that the center of the holding surface is caused to correspond with the center of the workpiece can selectively be executed, and thereafter, the workpiece can be ground.

The support component has the mark indicating the crystal orientation of the workpiece, and the holding surface of the chuck table has the same shape as the support component in plan view. Further, the chuck table includes the holding surface rotation unit that rotates the holding surface with the center of the holding surface being the axis. Therefore, the control unit can control the holding surface rotation unit and cause the mark of the support component of the bonded workpiece held by the conveying unit to match the corresponding mark that is formed in the holding surface and corresponds to the mark. By executing grinding thereafter, the workpiece can be thinned to even thickness.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
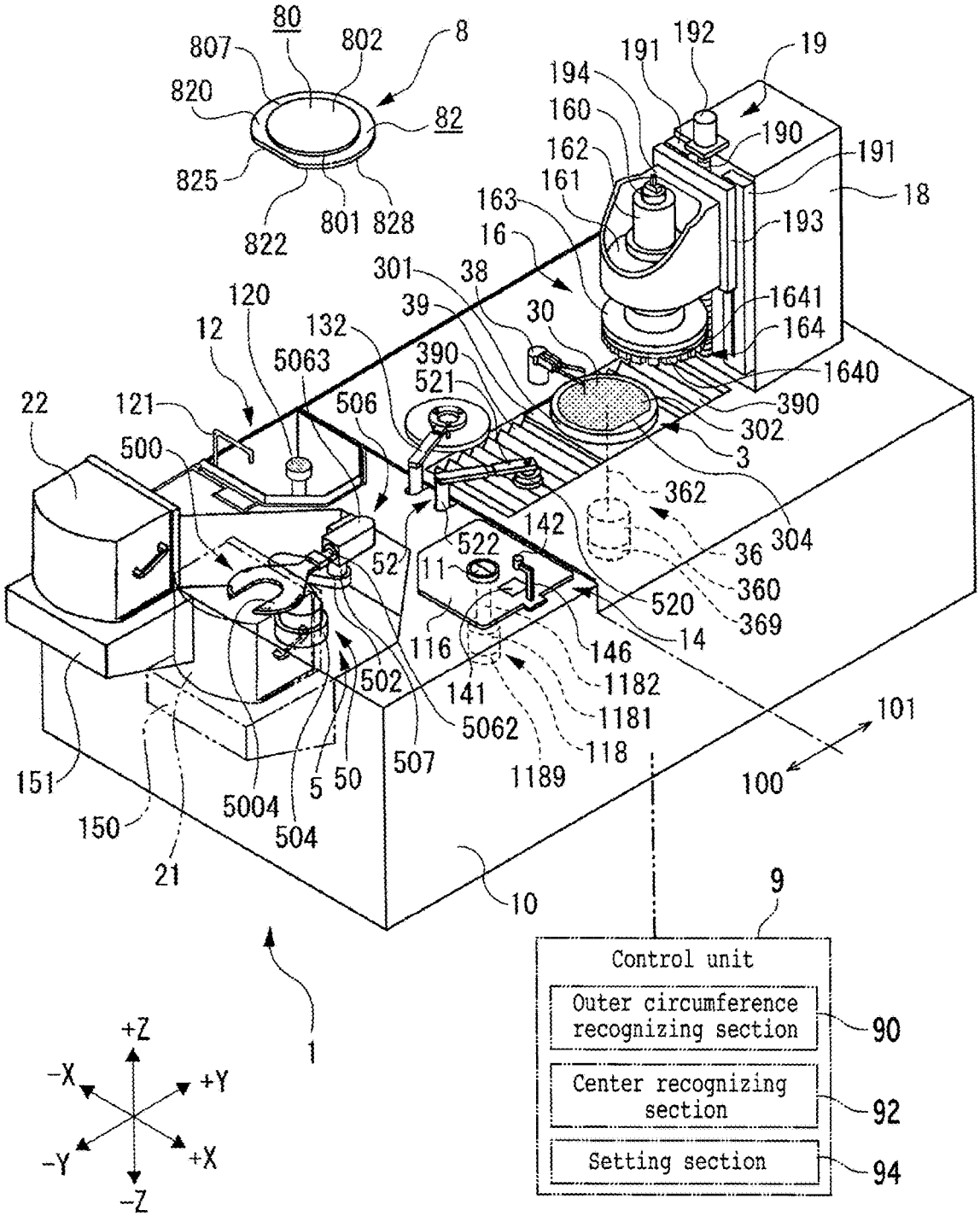
FIG. 1 is a perspective view illustrating one example of a grinding apparatus.

A grinding apparatus 1 illustrated in FIG. 1 is an apparatus that grinds, by a grinding unit 16, a workpiece 80 of a bonded workpiece 8 held by a chuck table 30 that configures a holding unit 3. The front side (−Y direction side) on an apparatus base 10 of the grinding apparatus 1 serves as a carrying-in/out region 100 that is a region in which the bonded workpiece 8 is carried into and out from the chuck table 30. The rear side (+Y direction side) on the apparatus base 10 serves as a processing region 101 that is a region in which grinding processing of the bonded workpiece 8 held on the chuck table 30 is executed by the grinding unit 16.

It is to be noted that the processing apparatus according to the present invention may have such a configuration that includes two axes of a coarse grinding unit and a finishing grinding unit as grinding units and positions the chuck table 30 that holds the bonded workpiece 8 to the lower side of the respective grinding units by a turn table that rotates.

A workpiece to be ground by the grinding apparatus 1 is the bonded workpiece 8 obtained by bonding at least two transparent components or semitransparent components, more specifically, the workpiece 80 that is a circular plate illustrated in FIG. 1 and is transparent or semitransparent and a support component 82 that is a circular plate with such a size as to protrude from an outer circumference 807 of the workpiece 80 to the outside and is transparent or semitransparent, to each other.

For example, the workpiece 80 is a circular wafer composed of lithium tantalate that is a transparent or semitransparent component. A front surface 801 of the workpiece 80 oriented downward in FIG. 1 is bonded to a front surface 820 of the support component 82 by using an adhesive or the like that is not illustrated in the diagram. The back surface of the workpiece 80 on the opposite side to the front surface 801 of the workpiece 80 is a grinding-target surface 802 on which grinding processing is to be executed. It is to be noted that the workpiece 80 may be a wafer composed of SiC that is a transparent or semitransparent component.

The support component 82 with a larger diameter than that of the workpiece 80 is composed of transparent or semitransparent glass, and a back surface 822 oriented downward in FIG. 1 becomes a held surface to be held by a holding surface 302 of the chuck table 30. The support component 82 may be composed of sapphire, spinel, or the like that is a transparent or semitransparent component, besides glass. The glass that configures the support component 82 may be colored transparently or semi-transparently.

The bonded workpiece 8 makes it possible to improve the handling property of the thin workpiece 80 that has been ground and prevent warpage and breakage of the workpiece 80 through treating and processing the workpiece 80 and the support component 82 integrally. The center of the workpiece 80 and the center of the support component 82 in the bonded workpiece 8 slightly deviate from each other, in some cases.

In the present embodiment, a mark 825 indicating the crystal orientation of the workpiece 80 is formed at an outer circumference 828 of the support component 82. This mark 825 is formed by cutting off an outer circumferential part of the support component 82 flatly in a tangential direction, for example.

It is to be noted that, in the workpiece 80, an orientation flat that is a mark indicating the crystal orientation may be formed by flatly cutting off part of the outer circumference. Alternatively, a notch indicating the crystal orientation of the workpiece 80 may be formed at the outer circumference of the workpiece 80 in the state of being hollowed inward in the radial direction toward the center of the workpiece 80. In these cases, the support component 82 may have a circular shape in which the mark 825 indicating the crystal orientation of the workpiece 80 is not formed.

On the front side (−Y direction side) of the apparatus base 10 of the grinding apparatus 1, a first cassette stage 150 and a second cassette stage 151 are each disposed to place thereon a cassette in which plural bonded workpieces 8 can be housed in a shelf-like manner. A first cassette 21 in which plural bonded workpieces 8 that are yet to be processed are housed in a shelf-like manner is placed on the first cassette stage 150, and a second cassette 22 in which plural bonded workpieces 8 that have been processed are housed in a shelf-like manner is placed on the second cassette stage 151.

The grinding apparatus 1 includes a conveying unit 5 that conveys the bonded workpiece 8 to the holding surface 302 of the holding unit 3 to cause the holding surface 302 to hold the bonded workpiece 8. In the present embodiment, the conveying unit 5 includes a robot 50 that carries the bonded workpiece 8 out from the first cassette 21 and a loading arm 52 that conveys, for example, the bonded workpiece 8 that is placed on a temporary placement table 11 by the robot 50 and in which the center of the workpiece 80 or the center of the support component 82 has been recognized, from the temporary placement table 11 to the chuck table 30.

As illustrated in FIG. 1, the robot 50 is disposed on the rear side of an opening of the first cassette 21 on the +Y direction side. The robot 50 is an articulated robot and includes a robot hand 500 having a suction adhesion surface that holds the bonded workpiece 8 by suction adhesion, a hand horizontal movement mechanism 502 that moves the robot hand 500 in the horizontal direction, a hand vertical movement mechanism 504 such as an electric actuator that moves the robot hand 500 in the vertical direction, and a hand reversal mechanism 506 that vertically reverses a suction adhesion surface 5004 of the robot hand 500, for example.

For example, the hand horizontal movement mechanism 502 has such a structure that swings, by a swing motor, a swing arm including plural arm components and so forth and internally having a pulley mechanism. The hand horizontal movement mechanism 502 can cause swing movement of the robot hand 500 in the horizontal plane (in the X-axis-Y-axis plane) and can cause linear motion of the robot hand 500 in the horizontal plane while transforming the plural arm components from the state of intersecting each other to the state of being a mutually straight line manner or other states.

The hand vertical movement mechanism 504 is connected to the lower part side of the hand horizontal movement mechanism 502. The hand vertical movement mechanism 504 vertically moves the robot hand 500 together with the hand horizontal movement mechanism 502 in a Z-axis direction and positions the robot hand 500 to a predetermined height.

To the arm component of the hand horizontal movement mechanism 502, a housing 5063 that rotatably supports a spindle 5062 having the axial center in the Y-axis direction orthogonal to the Z-axis direction in FIG. 1 is fixed with the intermediary of a columnar arm joining part 507. For example, a reversal motor that rotationally drives the spindle 5062 is housed inside the housing 5063.

The tip side of the spindle 5062 protrudes from the housing 5063 in the −Y direction, and a holder to which the root side of the robot hand 500 is mounted is disposed on this tip side. In association with rotation of the spindle 5062 by a predetermined angle by the reversal motor that is not illustrated in the diagram, the robot hand 500 connected to the spindle 5062 through the holder rotates, and the suction adhesion surface 5004 of the robot hand 500 can be reversed and switched.

The plate-shaped robot hand 500 that holds the bonded workpiece 8 by suction adhesion has an outer shape of a substantially U-shape in plan view as a whole, for example. It is to be noted that the robot hand 500 is not limited to the shape in the present embodiment and may have a substantially spatula shape in plan view as a whole.

For example, the surface of the robot hand 500 oriented upward in FIG. 1 is regarded as the suction adhesion surface 5004 that sucks and holds the bonded workpiece 8. It is to be noted that, in the robot hand 500, the opposite surface to the suction adhesion surface 5004 may also be a suction adhesion surface. The suction adhesion surface 5004 is smoothly finished. Further, the end part of the suction adhesion surface 5004 may be chamfered to prevent the bonded workpiece 8 from being scratched. Plural suction holes are opened in the suction adhesion surface 5004. It is to be noted that deformable rubber suction cups or the like may be disposed at the suction holes. Moreover, a resin tube having flexibility to avoid hindrance of swing movement of the robot hand 500 communicates with each suction hole through a joint or the like, and this resin tube is connected to a suction source such as a vacuum generating apparatus or an ejector mechanism.

The temporary placement table 11 is disposed at a position adjacent to the robot 50. For example, the temporary placement table 11 with a circular shape has a smaller diameter than that of the bonded workpiece 8, and the flat upper surface of the temporary placement table 11 serves as a temporary placement surface on which the bonded workpiece 8 is temporarily placed. The temporary placement surface communicates with a suction source not illustrated in the diagram and can suck and hold the bonded workpiece 8.

A temporary placement table rotation unit 118 including a motor 1181, a spindle 1182, and so forth is connected to the lower side of the temporary placement table 11, and the temporary placement table 11 can be rotated by the spindle 1182 having the axis direction along the Z-axis direction. The spindle 1182 is rotatably supported by a temporary placement table support base 116 disposed over the apparatus base 10 with the intermediary of a bearing or the like that is not illustrated in the diagram.

The motor 1181 is, for example, a servomotor, and an encoder 1189 of the motor 1181 is connected to a control unit 9 that has a function as a servo amplifier and is illustrated in FIG. 1. After an operation signal is supplied from an output interface of the control unit 9 to the motor 1181 and the spindle 1182 rotates, the encoder 1189 outputs a detected rotation angle to an input interface of the control unit 9, as an encoder signal. Then, the control unit 9 that has received the rotation angle of the motor 1181 as the encoder signal can recognize the rotation angle of the temporary placement table 11.

In the present embodiment, an imaging unit 14 that images the bonded workpiece 8 is disposed near the temporary placement table 11. Further, the imaging unit 14 includes, for example, a coaxial episcopic illuminator 141 and a camera 142 opposed to the illuminator 141 in the Z-axis direction. The illuminator 141 is disposed on the temporary placement table support base 116 and is located on the lower side relative to the temporary placement table 11.

The illuminator 141 is configured by plural light emitting diodes (LED) that can emit visible light, for example. However, the illuminator 141 is not limited thereto and may be a xenon lamp or the like. When the illuminator 141 is provided with power from a power supply that is connected to the illuminator 141 and is not illustrated in the diagram, the illuminator 141 radiates light and emits the light to the upper side toward the camera 142.

For example, the camera 142 is attached to the tip of the upper part of a support column 146 that is disposed upright on the temporary placement table support base 116 and that has a substantially L-shape in side view, and is configured by an optical system such as a lens that captures light emitted from the illuminator 141, a light receiving element such as a charge-coupled device (CCD) that outputs a subject image formed by the optical system, and so forth. It is to be noted that the camera 142 may be movable in the horizontal direction.

The loading arm 52 is disposed near the temporary placement table 11. The loading arm 52 includes an arm part 521 that extends in parallel to the horizontal direction and has a tip with the lower surface side on which a conveying pad 520 is mounted, a swing shaft part 522 that has the axis direction along the Z-axis direction and causes swing movement of the arm part 521 in the horizontal direction, and the conveying pad 520 that sucks and holds the bonded workpiece 8 by the lower surface thereof. For example, the loading arm 52 can vertically be moved by a cylinder mechanism that is not illustrated in the diagram. For example, the loading arm 52 sucks and holds the bonded workpiece 8 temporarily placed on the temporary placement table 11 and conveys the bonded workpiece 8 to the chuck table 30 of the holding unit 3 positioned near the loading arm 52.

In the example illustrated in FIG. 1, the conveying pad 520 has a smaller diameter than that of the workpiece 80 and sucks and holds only the central region of the grinding-target surface 802 of the workpiece 80. However, the conveying pad 520 may have such a configuration that sucks and holds substantially the whole of the grinding-target surface 802 of the workpiece 80. The conveying pad 520 can suck and hold the bonded workpiece 8 by the flat lower surface formed of a porous component or the like.

An unloading arm 132 that includes a suction pad and so forth and swings in the state of sucking and holding the grinding-target surface 802 of the processed workpiece 80 is disposed adjacently to the loading arm 52.

A single-wafer cleaning unit 12 that cleans the bonded workpiece 8 which has been processed and is conveyed by the unloading arm 132 is disposed in the movable range of the unloading arm 132. The cleaning unit 12 sucks and holds the support component 82 by a spinner table 120 with a smaller diameter than that of the bonded workpiece 8 and jets cleaning water from a cleaning nozzle 121 that makes swing movement above the held workpiece 80, to the grinding-target surface 802 that is the upper surface of the rotated workpiece 80, to execute cleaning of the grinding-target surface 802. Further, the cleaning nozzle 121 can jet air and dry the bonded workpiece 8 that has been cleaned.

The holding unit 3 includes the chuck table 30 and can suck and hold the support component 82 of the bonded workpiece 8 by the holding surface 302. In the present embodiment, the chuck table 30 includes a suction adhesion part 300 that is formed of a porous component or the like and that causes suction adhesion of the support component 82 and a frame body 301 that supports the suction adhesion part 300. The suction adhesion part 300 communicates with a suction source that is not illustrated in the diagram, such as a vacuum generating apparatus, and a suction force generated due to suction by the suction source is transmitted to the holding surface 302, which is the exposed surface (upper surface) of the suction adhesion part 300. This allows the chuck table 30 to suck and hold the bonded workpiece 8 on the holding surface 302.

For example, the holding surface 302 has the same shape as the support component 82 in plan view in such a manner as to correspond to the mark 825 that is a flat cut part that is formed in the support component 82 and indicates the crystal orientation of the workpiece 80. That is, the outer circumference of the suction adhesion part 300 with a circular shape is flatly cut off in a tangential direction corresponding to the mark 825, and a corresponding mark 304 is formed. It is to be noted that the center of the holding surface 302 of the chuck table 30 of the holding unit 3 is the center of a perfect circle when it is assumed that the holding surface 302 has the shape of the perfect circle, for example.

The chuck table 30 is surrounded by a cover 39 that configures the holding unit 3, and is allowed to reciprocate over the apparatus base 10 in the Y-axis direction by a table movement mechanism that is disposed below the cover 39 and a bellows cover 390 joined to the cover 39 and that is not illustrated in the diagram. The table movement mechanism that is not illustrated in the diagram is a ball screw mechanism or the like that causes linear motion of the an electric slider in the Y-axis direction.

The holding unit 3 includes a holding surface rotation unit 36 that rotates the chuck table 30 with the center of the holding surface 302 being the axis. The holding surface rotation unit 36 has a configuration in which a spindle 362 is connected to the lower side of the chuck table 30 and in which the spindle 362 is rotationally driven by a motor 360.

The motor 360 is, for example, a servomotor, and a rotary encoder 369 of the motor 360 is connected to the control unit 9 having also a function as a servo amplifier. After an operation signal is supplied from the output interface of the control unit 9 to the motor 360 and the spindle 362 is rotated, the rotary encoder 369 outputs the rotation angle of the spindle 362 to the input interface of the control unit 9, as an encoder signal. Then, the control unit 9 that has received the encoder signal can recognize the rotation angle of the chuck table 30 and the position in the circumferential direction regarding the corresponding mark 304 that is the flat cut part corresponding to the mark 825 of the support component 82 on the holding surface 302 of the chuck table 30.

A column 18 is disposed upright on the rear side (+Y direction side) of the processing region 101, and a grinding feed mechanism 19 that executes grinding feed of the grinding unit 16 and the chuck table 30 relatively in the Z-axis direction perpendicular to the holding surface 302 is disposed on the front surface of the column 18 on the −Y direction side. The grinding feed mechanism 19 includes a ball screw 190 having the axial center in the Z-axis direction, a pair of guide rails 191 disposed in parallel to the ball screw 190, a motor 192 that is joined to the upper end of the ball screw 190 and rotates the ball screw 190, a rising-lowering plate 193 that internally has a nut screwed to the ball screw 190 and has side parts in slide contact with the guide rails 191, and a holder 194 that is joined to the rising-lowering plate 193 and holds the grinding unit 16. When the motor 192 rotates the ball screw 190, the rising-lowering plate 193 reciprocates in the Z-axis direction while being guided by the guide rails 191 in association with this, and grinding feed of the grinding unit 16 held by the holder 194 is executed in the Z-axis direction.

The grinding unit 16 that grinds, by abrasive stones 1640, the workpiece 80 of the bonded workpiece 8 held by the holding surface 302 of the holding unit 3 includes a rotating shaft 160 having the axis direction along the Z-axis direction, a housing 161 that rotatably supports the rotating shaft 160, a motor 162 that rotationally drives the rotating shaft 160, a mount 163 that is connected to the lower end of the rotating shaft 160 and has a circular annular shape, and a grinding wheel 164 detachably mounted on the lower surface of the mount 163.

The grinding wheel 164 includes a wheel base 1641 and the plural abrasive stones 1640 that are annularly disposed on the bottom surface of the wheel base 1641 and have a substantially rectangular parallelepiped shape. The abrasive stones 1640 are shaped through fixing of grinding abrasive grains or the like by a predetermined binder or the like, for example.

Inside the rotating shaft 160, a flow path that serves as a passage of grinding water and is not illustrated in the diagram is formed to penetrate in the axis direction of the rotating shaft 160 (Z-axis direction). This flow path passes through the mount 163 and is opened in the bottom surface of the wheel base 1641 in such a manner as to allow the grinding water to be ejected toward the abrasive stones 1640.

At a position near the grinding wheel 164 lowered to a height position when the workpiece 80 is ground, for example, a thickness measurement unit 38 that measures the thickness of the workpiece 80 by a contact system in grinding is disposed. The thickness measurement unit 38 may be a thickness measurement unit of a contactless system.

The grinding apparatus 1 includes an outer circumference recognizing section 90 that, before the bonded workpiece 8 is held by the holding surface 302 of the holding unit 3, distinguishes between the outer circumference 807 of the workpiece 80 and the outer circumference 828 of the support component 82 and recognizes the outer circumferences from a taken image that is obtained by imaging the bonded workpiece 8 by the imaging unit 14 and includes the outer circumference 807 of the workpiece 80 and the outer circumference 828 of the support component 82. The grinding apparatus 1 also includes a center recognizing section 92 that recognizes the center of the support component 82 from the outer circumference 828 of the support component 82 recognized by the outer circumference recognizing section 90 and recognizes the center of the workpiece 80 from the outer circumference 807 of the workpiece 80 recognized by the outer circumference recognizing section 90. The grinding apparatus 1 also includes a setting section 94 that sets whether the center of the holding surface 302 is caused to correspond with the center of the support component 82 or the center of the holding surface 302 is caused to correspond with the center of the workpiece 80 when the holding surface 302 is caused to hold the bonded workpiece 8. The grinding apparatus 1 also includes the control unit 9 that controls at least the conveying unit 5, i.e., the robot 50 and the loading arm 52, in order to cause the holding surface 302 to hold the bonded workpiece 8, according to the setting of the setting section 94.

In the present embodiment, the control unit 9 can execute control of the overall apparatus in which control regarding constituent elements of the invention other than the conveying unit 5 can also be executed. However, the control unit 9 may be a unit separate from the control unit that executes the control of the overall apparatus. The control unit 9 includes a processor that executes arithmetic processing according to a control program, a storage medium such as a memory, and so forth and is electrically connected to the robot 50 of the conveying unit 5, the loading arm 52 of the conveying unit 5, the holding surface rotation unit 36, the temporary placement table rotation unit 118, and so forth through wired or wireless communication paths that are not illustrated in the diagram. The control unit 9 executes control of carrying-out operation of the bonded workpiece 8 from the first cassette 21 by the robot 50, control of carrying-in operation of the bonded workpiece 8 that has been ground to the second cassette 22, control of conveyance operation of the bonded workpiece 8 from the temporary placement table 11 to the chuck table 30 by the loading arm 52, control of rotational operation of the chuck table 30 that sucks and holds the bonded workpiece 8, control of rotational operation of the temporary placement table 11 by the temporary placement table rotation unit 118, and so forth.

In the present embodiment, for example, the outer circumference recognizing section 90, the center recognizing section 92, and the setting section 94 are included in the control unit 9. The setting section 94 is set in one area of the storage medium of the control unit 9, for example. For example, the grinding apparatus 1 includes a touch panel or the like that is not illustrated in the diagram, as input means that allows an operator to input the processing conditions and so forth to the grinding apparatus 1. In the case in which an operator inputs, from the input means to the grinding apparatus 1, various kinds of information regarding the processing conditions (the grinding feed rate of the grinding unit 16, the rotation speed of the chuck table 30, and so forth) based on the kind of workpiece 80 and so forth in executing grinding processing on the bonded workpiece 8 by using the grinding apparatus 1, if the operator selects and inputs, for example, such a processing condition as to cause the center of the holding surface 302 to correspond with the center of the support component 82 when the holding surface 302 of the chuck table 30 is caused to hold the bonded workpiece 8, this selection result is set and stored in the setting section 94.

A program in which outer circumference recognition processing is described is stored in the storage medium of the control unit 9. The outer circumference recognizing section 90 reads out the program in which the outer circumference recognition processing is described, from the storage medium and executes it when taken image data is sent from the camera 142 of the imaging unit 14. A program in which center recognition processing is described is stored in the storage medium of the control unit 9. The center recognizing section 92 reads out the program in which the center recognition processing is described, from the storage medium and executes it when the outer circumference recognizing section 90 has recognized the outer circumference 807 of the workpiece 80 and recognized the outer circumference 828 of the support component 82.

A description will be made below about the respective steps in the case of executing a grinding method of the bonded workpiece 8 according to the present invention by using the grinding apparatus 1 according to the present invention illustrated in FIG. 1. In the present embodiment, suppose that, in executing setting of the processing conditions for the grinding apparatus 1 by an operator before start of grinding processing, not causing the center of the holding surface 302 of the chuck table 30 to correspond with the center of the support component 82 but causing the center of the holding surface 302 of the chuck table 30 to correspond with the center of the workpiece 80 is selected to be set in the setting section 94 when there is deviation between the center of the workpiece 80 and the center of the support component 82 in the bonded workpiece 8.

It is to be noted that, if a mark indicating the crystal orientation is formed in the workpiece 80 itself, setting may be executed in the setting section 94 in such a manner as to cause the center of the holding surface 302 of the chuck table 30 to correspond with the center of the support component 82.

(1) Carrying-Out of Bonded Workpiece 8 from First Cassette 21

For example, the robot hand 500 of the robot 50 is positioned to the height position of the workpiece 80 as a target in the first cassette 21. For example, in the first cassette 21, the grinding-target surface 802 of the workpiece 80 is oriented upward, and the outer circumferential part of the support component 82 is supported by the shelf. Then, for example, the suction adhesion surface 5004 of the robot hand 500 is set to the state of being oriented toward the upper side (+Z direction side).

The robot hand 500 is caused to swing and enters from the opening of the first cassette 21 to a predetermined position inside the first cassette 21. Then, the robot hand 500 is positioned in such a manner that the center of the robot hand 500 substantially corresponds with the center of the support component 82, for example. Subsequently, the robot hand 500 rises to bring the suction adhesion surface 5004 into contact with the back surface 822 of the support component 82 that is oriented downward, from the lower side of the support component 82, and sucks and holds the back surface 822. In addition, the robot hand 500 rises until the outer circumferential part of the support component 82 is slightly separated from the shelf.

Further, the robot hand 500 that sucks and holds the bonded workpiece 8 exits from the first cassette 21. It is to be noted that the robot hand 500 may cause the suction adhesion surface 5004 to abut against the bonded workpiece 8 from the upper side and suck and hold the workpiece 80 of the bonded workpiece 8.

(2-1) First Embodiment of Imaging Step

Subsequently, an imaging step of imaging the bonded workpiece 8 including the outer circumference 807 of the workpiece 80 and the outer circumference 828 of the support component 82 by the camera 142 is executed. The imaging step to be described below is an imaging step of a first embodiment and includes a temporary placement step of temporarily placing the bonded workpiece 8 on the temporary placement table 11 in such a manner that the outer circumference 807 of the workpiece 80 and the outer circumference 828 of the support component 82 are protruded from the temporary placement table 11.

Figure 2:
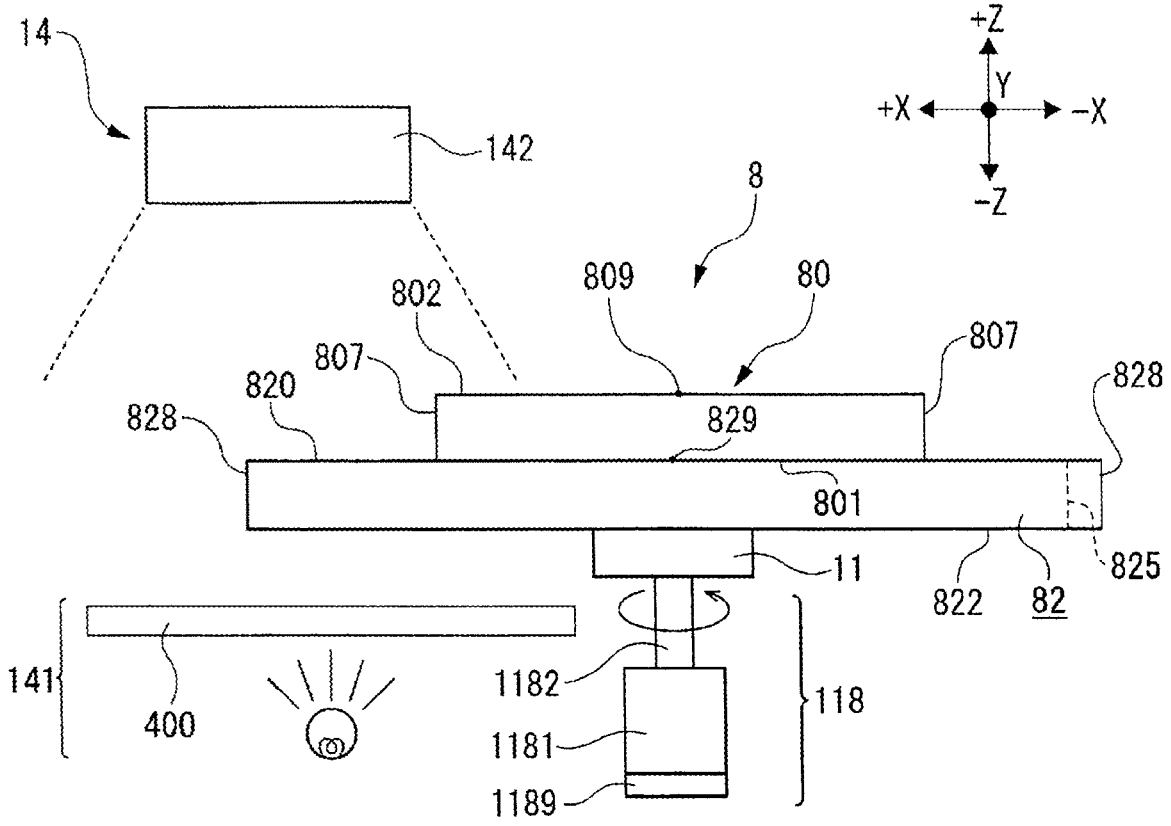
FIG. 2 is a side view illustrating the case of imaging a bonded workpiece by a camera in such a manner as to include the outer circumference of a workpiece and the outer circumference of a support component in an imaging step of a first embodiment.

Specifically, the robot 50 that configures the conveying unit 5 moves the bonded workpiece 8 to the upper side of the temporary placement table 11, and the center of the robot hand 500 is caused to substantially match the center of the temporary placement table 11. Then, by the robot 50, the bonded workpiece 8 is placed on the temporary placement table 11 with the back surface 822 of the support component 82 oriented downward. Specifically, the robot hand 500 lowers, and the bonded workpiece 8 is placed on the temporary placement table 11 in such a manner that the temporary placement table 11 enters the opening part of the U-shape of the robot hand 500. Further, as illustrated in FIG. 2, the bonded workpiece 8 is temporarily placed on the temporary placement table 11 in such a manner that the outer circumference 807 of the workpiece 80 and the outer circumference 828 of the support component 82 are protruded from the temporary placement table 11, and the bonded workpiece 8 is sucked and held. Thereafter, the robot hand 500 evacuates from the bonded workpiece 8.

As illustrated in FIG. 2, the outer circumference 807 of the workpiece 80 and the outer circumference 828 of the support component 82 in the bonded workpiece 8 temporarily placed on the temporary placement table 11 enter the state of having entered a space between the camera 142 and the illuminator 141. Then, for example, the camera 142 is focused on the upper surface of the bonded workpiece 8, and the outer circumference 807 of the workpiece 80 and the outer circumference 828 of the support component 82 are caused to fall within the imaging region of the camera 142. The illuminator 141 is turned on to emit illumination light (for example, visible light beam) to the upper side. Part of this illumination light is transmitted through the support component 82 that is a transparent component or semitransparent component and the workpiece 80 that is a transparent component or semitransparent component, to become transmitted light and be received by the light receiving element of the camera 142 through the optical system thereof, so that a first taken image 40 illustrated in FIG. 3 is formed.

For example, the first taken image 40 is an aggregation of pixels each having a brightness value expressed by 8-bit grayscale, i.e., 256 values of 0 to 255, and having a predetermined size. The brightness value in each pixel of the formed first taken image 40 is determined by the amount of light incident on each of the pixels of the light receiving element of the camera 142.

The illumination light emitted by the illuminator 141 is absorbed by the support component 82, which is a transparent or semitransparent component, to weaken, and is absorbed by the workpiece 80, which is a transparent or semitransparent component, on the support component 82 to further weaken. That is, the amount of light incident on the light receiving element corresponding to the support component 82 illustrated in FIG. 3 is large, and one pixel thereof becomes gray in the first taken image 40 of FIG. 3. The amount of light incident on the light receiving element corresponding to the workpiece 80 becomes smaller, and the brightness value of one pixel thereof lowers compared with the pixel indicating the support component 82, so that the one pixel becomes dark gray closer to black in the first taken image 40 of FIG. 3.

Figure 3:
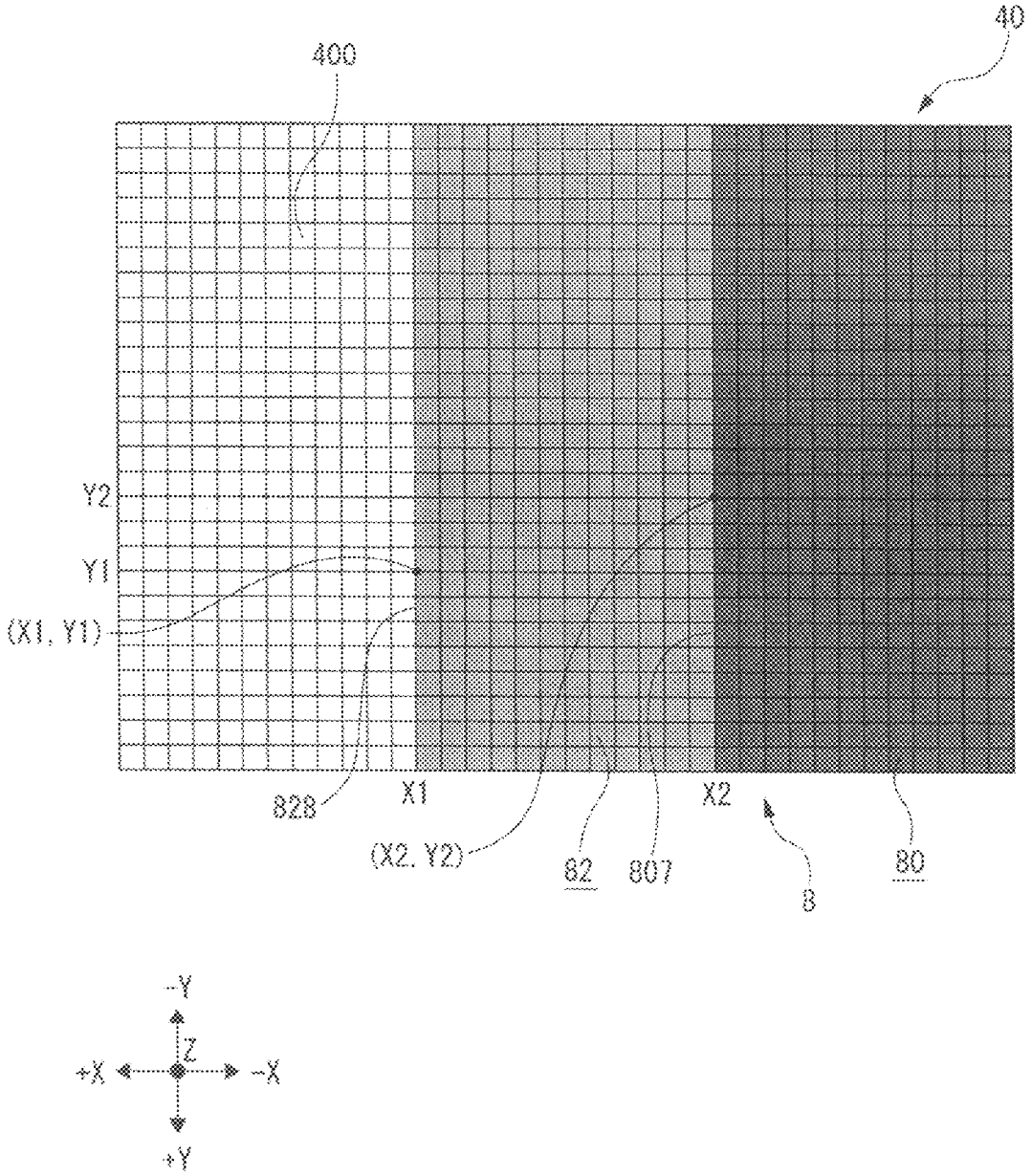
FIG. 3 is a schematic diagram illustrating one example of a taken image obtained by imaging the bonded workpiece in the imaging step.

The camera 142 transmits, to the control unit 9 illustrated in FIG. 1, the first taken image 40 of the bonded workpiece 8 in which the outer circumference 807 of the workpiece 80, the outer circumference 828 of the support component 82, and a space 400 (diffuser plate 400) on the outside relative to the support component 82 appear as illustrated in FIG. 3. This first taken image 40 is stored in the storage medium of the control unit 9.

For example, the temporary placement table 11 illustrated in FIG. 2 rotates, and the position of the outer circumferential part of the bonded workpiece 8 with respect to the fixed camera 142 can be changed. Then, plural places (for example, further two places separate from the previously-imaged place in the circumferential direction of the bonded workpiece 8) are imaged by the camera 142 to obtain similar taken images of the bonded workpiece 8 sucked and held by the temporary placement table 11. That is, a second taken image and a third taken image of the bonded workpiece 8 in which the outer circumference 807 of the workpiece 80, the outer circumference 828 of the support component 82, and the space 400 appear are further formed to be stored in the storage medium of the control unit 9.

(2-2) Second Embodiment of Imaging Step

As the imaging step, an imaging step of a second embodiment to be described below may be executed instead of the imaging step of the above-described first embodiment. In the imaging step of the second embodiment, the bonded workpiece 8 is imaged by the camera 142, including the outer circumference 807 of the workpiece 80 and the outer circumference 828 of the support component 82 in the bonded workpiece 8 held by the conveying unit 5 that conveys the bonded workpiece 8 illustrated in FIG. 1 to the holding surface 302 of the chuck table 30.

Specifically, for example, the conveying unit 5 is controlled by the control unit 9, and the robot 50 that has carried the bonded workpiece 8 out from the first cassette 21 in the state in which the workpiece 80 is oriented upward transfers the bonded workpiece 8 directly to the loading arm 52 without the intermediary of the temporary placement table 11.

Figure 4:
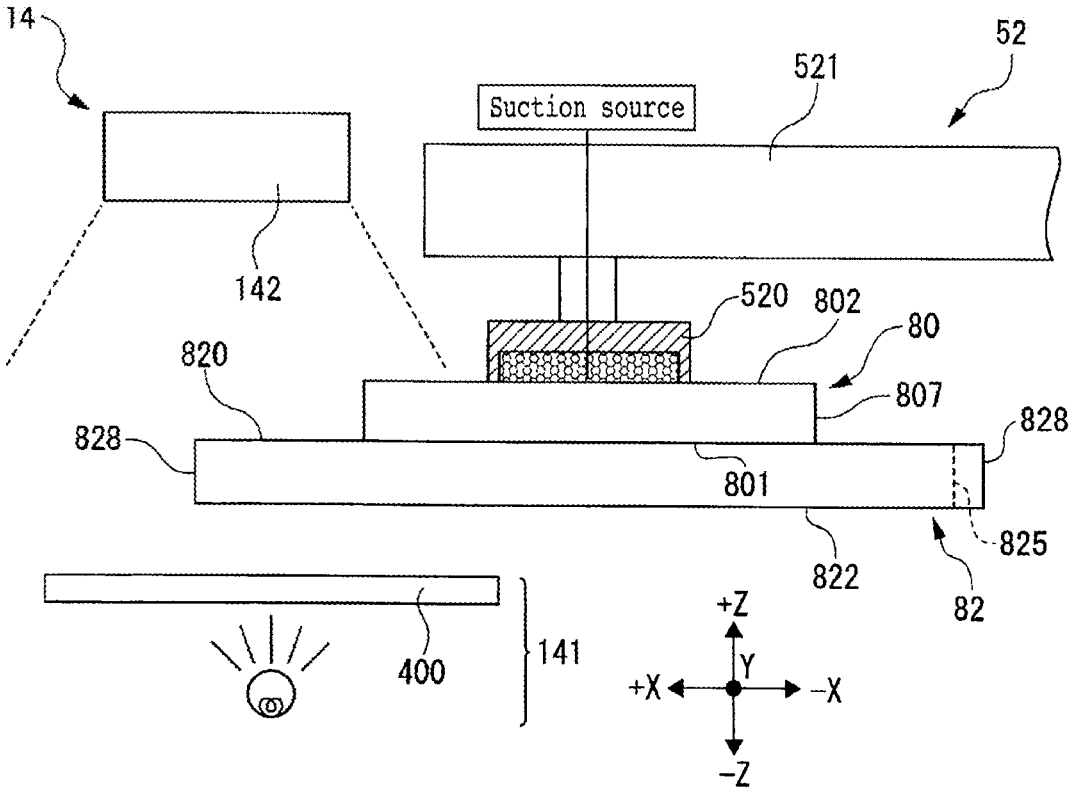
FIG. 4 is a side view illustrating the case of imaging the bonded workpiece by the camera in such a manner as to include the outer circumference of the workpiece and the outer circumference of the support component in an imaging step of a second embodiment.

As illustrated in FIG. 4, the loading arm 52 causes suction adhesion of the grinding-target surface 802 of the workpiece 80 to suck and hold the bonded workpiece 8. For example, the center of the lower surface of the conveying pad 520 as the holding surface substantially corresponds with the center of the support component 82. After the robot 50 that has transferred the bonded workpiece 8 to the loading arm 52 evacuates from the lower side of the bonded workpiece 8, the loading arm 52 causes swing movement and vertical movement of the bonded workpiece 8 and positions the bonded workpiece 8 to a position at which the outer circumference 807 of the workpiece 80 and the outer circumference 828 of the support component 82 in the bonded workpiece 8 enter a space between the camera 142 and the illuminator 141.

Thereafter, imaging of the bonded workpiece 8 by the imaging unit 14 is executed substantially similarly to the imaging step of the first embodiment. That is, with movement of the workpiece 80 by the loading arm 52, a first taken image, a second taken image, and a third taken image of the bonded workpiece 8 in which the outer circumference 807 of the workpiece 80, the outer circumference 828 of the support component 82, and the space 400 appear are formed. It is to be noted that, in the imaging step of the second embodiment, the bonded workpiece 8 may be imaged by the camera 142, including the outer circumference 807 of the workpiece 80 and the outer circumference 828 of the support component 82 in the bonded workpiece 8 held by the robot 50.

(3) Outer Circumference Recognition Step

For example, after the imaging step of the first embodiment (or second embodiment) is executed, an outer circumference recognition step is executed in which the outer circumference recognizing section 90 illustrated in FIG. 1 distinguishes between the outer circumference 828 of the support component 82 and the outer circumference 807 of the workpiece 80 and recognizes each of them on the basis of the brightness difference between pixels adjacent to each other in the first taken image 40 obtained in the imaging step, which is illustrated in FIG. 3.

The outer circumference recognizing section 90 causes the first taken image 40 illustrated in FIG. 3 to be displayed on a virtual output screen (X-axis-Y-axis orthogonal coordinate plane) with a predetermined resolution, for example. Then, on the basis of the brightness difference between pixels adjacent to each other in the first taken image 40, the outer circumference recognizing section 90 distinguishes between the outer circumference 828 of the support component 82 and the outer circumference 807 of the workpiece 80 and recognizes an X-axis coordinate X1 and an X-axis coordinate X2 of them.

It is to be noted that, in the first taken image 40 illustrated in FIG. 3, the case is given in which the outer circumference 828 of the support component 82 as the boundary part between the support component 82 and the space 400 and the outer circumference 807 of the workpiece 80 as the boundary part between the support component 82 and the workpiece 80 are imaged in such a manner that the respective pixels are aligned in the Y-axis direction without sticking out in the +X direction. However, the first taken image may be formed with the respective pixels sticking out in the +X direction, in some cases. That is, the taken image is formed in such a manner that pixels different in the brightness exist in a mixed manner at the boundary part (twelfth pixel column from the +X direction side in FIG. 3), in some cases.

In this case, for example, the outer circumference recognizing section 90 defines a provisional boundary part (twelfth pixel column from the +X direction side in FIG. 3) between the space 400 and the outer circumference 828 of the support component 82 in the first taken image 40 displayed on the output screen. Then, the number of pixels, in the Y-axis direction, with the brightness value indicating the space 400 (in FIG. 3, white) at this provisional boundary part is calculated. Further, the number of pixels, in the Y-axis direction, with the brightness value indicating the outer circumference 828 of the support component 82 (in FIG. 3, light gray) at this provisional boundary part is calculated. Then, it is determined that the twelfth pixel column indicates the space 400 when the calculated number of pixels indicating the space 400 is larger than the calculated number of pixels indicating the outer circumference 828 of the support component 82. If the calculated number of pixels indicating the space 400 is smaller than the calculated number of pixels indicating the outer circumference 828 of the support component 82, it may be determined that the twelfth pixel column indicates the outer circumference 828 of the support component 82.

For example, the outer circumference recognizing section 90 illustrated in FIG. 1 selects any one of pixels in the Y-axis direction on the X-axis coordinate X1 of the outer circumference 828 of the support component 82 in the first taken image 40 illustrated in FIG. 3, and recognizes the X-axis-Y-axis coordinates of the selected pixel as edge coordinates (X1, Y1) used for recognizing the center of the support component 82 in a center recognition step to be described later, to store them in the storage medium of the control unit 9. Further, the outer circumference recognizing section 90 selects any one of pixels in the Y-axis direction on the X-axis coordinate X2 of the outer circumference 807 of the workpiece 80 in the first taken image 40, and recognizes the X-axis-Y-axis coordinates of the selected pixel as edge coordinates (X2, Y2) used for recognizing the center of the workpiece 80 in the center recognition step to be described later, to store them in the storage medium of the control unit 9.

Such distinguishment and recognition of the outer circumference 828 of the support component 82 and the outer circumference 807 of the workpiece 80 by the outer circumference recognizing section 90 illustrated in FIG. 1 is also executed regarding the second taken image and the third taken image, which are not illustrated in the diagram, the second taken image and the third taken image indicating the outer circumference 828 of the support component 82 and the outer circumference 807 of the workpiece 80 and being obtained by imaging two places separate in the circumferential direction of the bonded workpiece 8. That is, further two sets of edge coordinates, which are not illustrated in the diagram, regarding the support component 82 and further two sets of edge coordinates, which are not illustrated in the diagram, regarding the workpiece 80 are stored in the storage medium of the control unit 9. It is to be noted that, without using the second taken image and the third taken image, from the first taken image 40, the outer circumference recognizing section 90 may select further two sets of edge coordinates, which are not illustrated in the diagram, in addition to the edge coordinates (X1, Y1) used for recognizing the center of the support component 82 and may select further two sets of edge coordinates, which are not illustrated in the diagram, in addition to the edge coordinates (X2, Y2) used for recognizing the center of the workpiece 80.

It is to be noted that, as described below, the outer circumference recognizing section 90 may recognize the outer circumference 828 of the support component 82 and the outer circumference 807 of the workpiece 80 from the first taken image 40, for example. For example, ten pixels that line up consecutively in the X-axis direction in the first taken image 40 illustrated in FIG. 3 and indicate the support component 82 are employed as a subject and are recognized as one group, and the differences in the brightness value between the pixels that are symmetric in the X-axis direction are obtained from the outside to the center of the ten pixels of the first group employed as the subject. Specifically, when the ten pixels of the first group are defined as a first pixel, a second pixel, . . . , a ninth pixel, and a tenth pixel from the +X direction side, the brightness difference between the first pixel and the tenth pixel, the brightness difference between the second pixel and the ninth pixel, the brightness difference between the third pixel and the eighth pixel, the brightness difference between the fourth pixel and the seventh pixel, and the brightness difference between the fifth pixel and the sixth pixel, i.e., five brightness differences in total, are calculated. As one example, when the brightness value of the first pixel is 255 and the brightness value of the tenth pixel is 255, the brightness difference between the first pixel and the tenth pixel is 0.

In addition, the sum of the calculated five brightness differences is calculated as a group value of the first group. This group value indicates the brightness of the central pixels adjacent to each other in the ten pixels that configure the first group. As one example, the group value of the first group is 0.

Similarly to the above description, the ten pixels that include, as the first pixel, the leading pixel resulting from shifting by one pixel from the first group toward the central side of the support component 82, i.e., toward the −X direction side in FIG. 3 (second pixel in the first group), are recognized as a second group. Further, the group value of the second group is calculated similarly to the case of the calculation of the first group value. In addition, the group value of a third group, the group value of a fourth group, the group value of a fifth group, and so forth are calculated one after another from the outer circumferential side of the support component 82 toward the central side.

Figure 5:
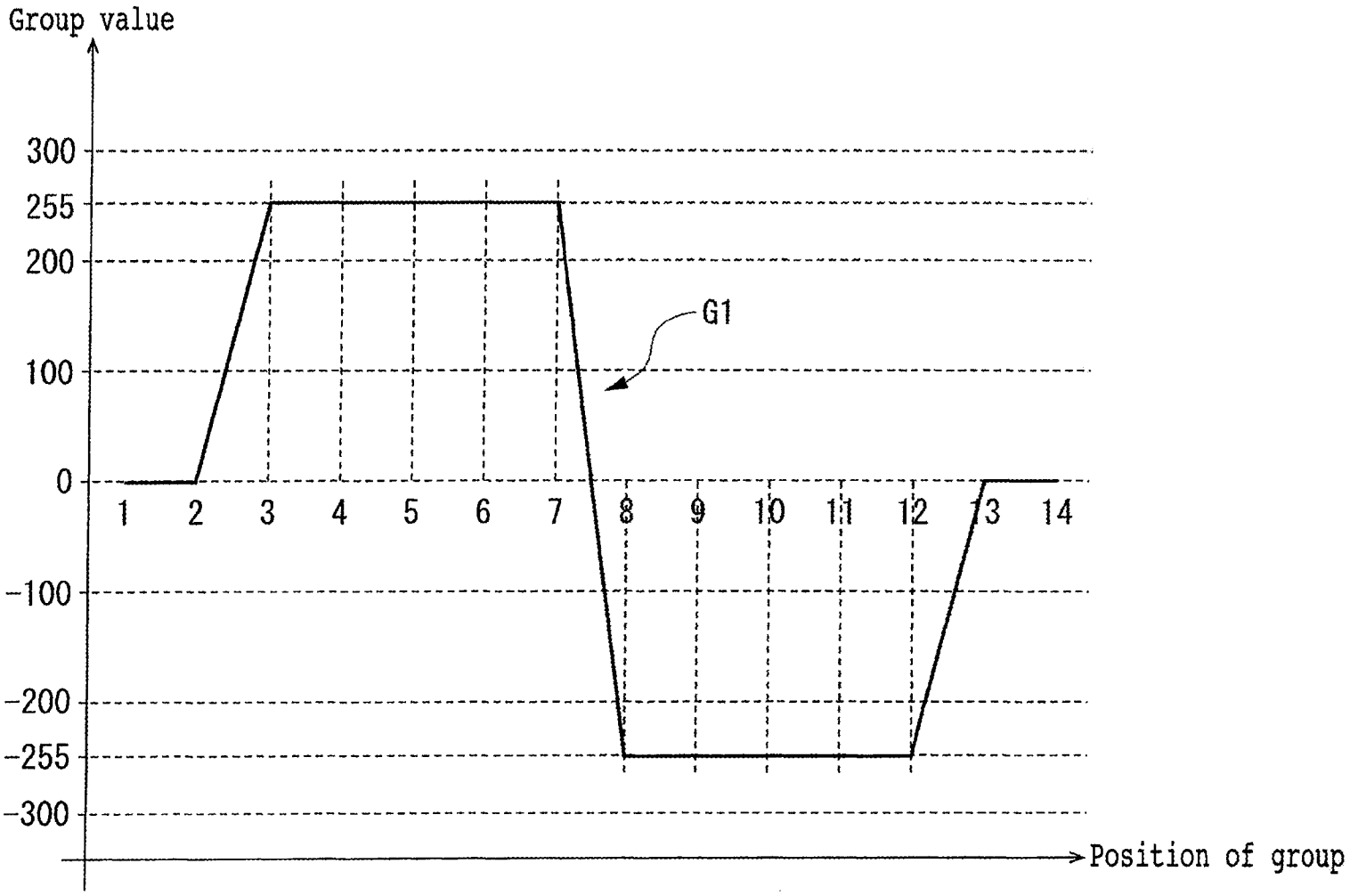
FIG. 5 is one example of a graph in which a group value is indicated as the ordinate axis and the abscissa axis is indicated as the position in an X-axis direction in the taken image.

Further, the outer circumference recognizing section 90 creates a graph G1 illustrated in FIG. 5. In the graph G1, the group value of the first group, the group value of the second group, the group value of the third group, and so forth that have been calculated are indicated on the ordinate axis, and the abscissa axis is defined as the position of the group in the X-axis direction in the first taken image 40 illustrated in FIG. 3. Then, as illustrated in the graph G1, for example, the group value changes from the group value of the seventh group=255 to the group value of the eighth group=−255, and it is thus recognized that the group value greatly swings. The X-axis coordinate position in FIG. 3 regarding the eighth group with this great swing of the group value is then recognized as the edge coordinate indicating the outer circumference 807 of the workpiece 80. That is, the group value is recognized as the brightness value of the central pixel in the ten pixels, and the coordinate across which the difference in the brightness value between pixels adjacent to each other is large is recognized as the edge coordinate. For example, the group value is recognized as the brightness value of the fifth pixel.

(4) Center Recognition Step

Subsequently, the center recognition step is executed in which, by the center recognizing section 92 illustrated in FIG. 1, the center of the support component 82 is recognized from the outer circumference 828 of the support component 82 recognized in the outer circumference recognition step and in which the center of the workpiece 80 is recognized from the outer circumference 807 of the workpiece 80 recognized in the outer circumference recognition step. The center recognition step is executed by conventionally-known geometric arithmetic processing based on the edge coordinates of three points.

Specifically, on the basis of three sets of edge coordinates including the edge coordinates (X1, Y1) regarding the support component 82 of the bonded workpiece 8 temporarily placed on the temporary placement table 11, a first virtual straight line that links the edge coordinates (X1, Y1) and a second set of edge coordinates regarding the support component 82 is defined on a virtual screen. In addition, a second virtual straight line that links the edge coordinates (X1, Y1) and a third set of edge coordinates regarding the support component 82 is defined, and the intersection of a first perpendicular line that passes through the midpoint of the first virtual straight line and a second perpendicular line that passes through the midpoint of the second virtual straight line is recognized as a center 829 (see FIG. 2) of the support component 82. The center recognizing section 92 executes work similar to the work of recognizing the center of the support component 82, by using three sets of edge coordinates regarding the workpiece 80 including the edge coordinates (X2, Y2), so that a center 809 (see FIG. 2) of the workpiece 80 is recognized.

(5) Holding Step

After the center 829 of the support component 82 and the center 809 of the workpiece 80 in the bonded workpiece 8 held by the temporary placement table 11 illustrated in FIG. 2, for example, are recognized as described above, the holding surface 302 of the holding unit 3 is caused to hold the support component 82 of the bonded workpiece 8. In the holding step, one of cases, that is, the case in which the holding surface 302 is caused to hold the support component 82 in such a manner that the center of the holding surface 302 is caused to correspond with the recognized center 829 of the support component 82 and the case in which the holding surface 302 is caused to hold the support component 82 in such a manner that the center of the holding surface 302 is caused to correspond with the recognized center 809 of the workpiece 80, is selectively executed.

In the present embodiment, causing the center of the holding surface 302 of the chuck table 30 to correspond with the center 809 of the workpiece 80 of the bonded workpiece 8 is set in the setting section 94 illustrated in FIG. 1 by the operator before start of processing. Therefore, under control of the control unit 9, holding work is executed in such a manner that the center of the holding surface 302 corresponds with the recognized center 809 of the workpiece 80. Further, in the present embodiment, the mark 825 indicating the crystal orientation of the workpiece 80 is formed in the support component 82, and the holding surface 302 of the holding unit 3 has the same shape as the support component 82 in plan view and has the corresponding mark 304 that is the flat cut part. Therefore, the control unit 9 controls the holding surface rotation unit 36 and also executes control to cause the mark 825 of the support component 82 of the bonded workpiece 8 held by the loading arm 52 of the conveying unit 5, to correspond with the corresponding mark 304 that is formed in the holding surface 302 and corresponds to the mark 825.

Specifically, for example, imaging of the bonded workpiece 8 is executed by the imaging unit 14 on the temporary placement table 11 illustrated in FIG. 2, and the mark 825 of the support component 82 is recognized from the taken image by, for example, the outer circumference recognizing section 90 of the control unit 9. Further, the motor 1181 of the temporary placement table rotation unit 118 is controlled by the control unit 9, the temporary placement table 11 that sucks and holds the bonded workpiece 8 is rotated by a predetermined angle, and the mark 825 of the support component 82 is positioned in a predetermined direction.

In addition, control of the loading arm 52 of the conveying unit 5 is executed by the control unit 9, and the conveying pad 520 is positioned to the upper side of the workpiece 80 in such a manner that the center 809 (see FIG. 2) of the grinding-target surface 802 of the workpiece 80 oriented upward at the temporary placement table 11 corresponds with the center of the conveying pad 520, for example. Subsequently, the conveying pad 520 lowers and gets contact with the grinding-target surface 802 of the workpiece 80 to suck and hold the workpiece 80. Then, the conveying pad 520 rises, and the workpiece 80 is carried out from the temporary placement table 11.

The position of the mark 825 of the support component 82 in the circumferential direction at the time when the loading arm 52 illustrated in FIG. 1 holds the workpiece 80 has already been recognized by the control unit 9 when the workpiece 80 is held and is carried out from the temporary placement table 11. Therefore, the holding surface rotation unit 36 is controlled by the control unit 9, the chuck table 30 is rotated by a predetermined angle, and position adjustment is executed to cause the position of the mark 825 of the bonded workpiece 8 to correspond with the position of the corresponding mark 304 of the chuck table 30. Then, in such a manner that the center of the holding surface 302 of the chuck table 30 corresponds with the center of the conveying pad 520, the bonded workpiece 8 is placed on the holding surface 302 in the state in which the grinding-target surface 802 of the workpiece 80 is oriented upward. Because the bonded workpiece 8 has been held by the loading arm 52 in such a manner that the center 809 of the workpiece 80 corresponds with the center of the conveying pad 520, the state in which the center of the holding surface 302 corresponds with the center 809 of the workpiece 80 is made. Further, the corresponding mark 304 formed in the holding surface 302 matches the mark 825 of the support component 82. Then, a suction force generated by the suction source that is not illustrated in the diagram is transmitted to the holding surface 302, and thereby, the holding unit 3 sucks and holds the side of the support component 82 of the bonded workpiece 8 by the holding surface 302.

(6) Grinding Step

After the holding step is executed through selecting such a processing condition as to cause the center of the holding surface 302 of the chuck table 30 to correspond with the center 809 of the workpiece 80 of the bonded workpiece 8, the table movement mechanism that is not illustrated in the diagram moves the chuck table 30 in the +Y direction. Then, the chuck table 30 that holds the bonded workpiece 8 positions the workpiece 80 in such a manner that the rotation center of the grinding wheel 164 of the grinding unit 16 deviates from the rotation center 809 of the workpiece 80 in the horizontal direction by a predetermined distance and that the rotation locus of the grinding abrasive stones 1640 passes through the rotation center 809 of the workpiece 80.

Further, the grinding unit 16 is sent in the −Z direction by the grinding feed mechanism 19, and the grinding abrasive stones 1640 that rotate abut against the grinding-target surface 802 of the workpiece 80 held by the chuck table 30. Thereby, grinding is executed. Further, the workpiece 80 over the holding surface 302 also rotates in association with rotation of the chuck table 30 at a predetermined rotational speed by the holding surface rotation unit 36. Thus, the grinding abrasive stones 1640 execute grinding processing of the whole of the grinding-target surface 802 of the workpiece 80. In the grinding, the grinding water is supplied to the contact part between the grinding abrasive stones 1640 and the grinding-target surface 802 of the workpiece 80 to cool and clean the contact part.

In the grinding processing, the thickness of the workpiece 80 is successively measured by the thickness measurement unit 38. Then, after the grinding unit 16 rises and is separated from the workpiece 80 normally ground to the finished thickness, the chuck table 30 moves in the −Y direction and moves to the vicinity of the unloading arm 132 by the table movement mechanism that is not illustrated in the diagram.

(7) Work after Grinding of Workpiece 80

Subsequently, the unloading arm 132 sucks and holds the grinding-target surface 802 of the bonded workpiece 8 and conveys the bonded workpiece 8 from the chuck table 30 to the spinner table 120. Subsequently, the cleaning nozzle 121 jets the cleaning water toward the workpiece 80 on the lower side while making swing movement in such a manner as to reciprocate at a predetermined angle over the workpiece 80. Further, the spinner table 120 that sucks and holds the bonded workpiece 8 rotates at a predetermined rotational speed. Thereby, the cleaning water is supplied to the whole of the grinding-target surface 802 of the workpiece 80, and cleaning is executed.

After the cleaning and drying of the bonded workpiece 8 are executed in the cleaning unit 12, the robot 50 carries the bonded workpiece 8 out from the cleaning unit 12 and houses the bonded workpiece 8 in the second cassette 22.

As described above, the grinding method of the bonded workpiece 8 according to the present invention includes the imaging step of imaging the bonded workpiece 8 including the outer circumference 807 of the workpiece 80 and the outer circumference 828 of the support component 82 by the camera 142 before the holding step. The grinding method also includes the outer circumference recognition step of recognizing each of the outer circumference 828 of the support component 82 and the outer circumference 807 of the workpiece 80 on the basis of the brightness difference between pixels adjacent to each other in a taken image obtained by the imaging the bonded workpiece 8 in the imaging step. The grinding method also includes the center recognition step of recognizing the center 829 of the support component 82 from the outer circumference 828 of the support component 82 recognized in the outer circumference recognition step and recognizing the center 809 of the workpiece 80 from the outer circumference 807 of the workpiece 80 recognized in the outer circumference recognition step. Accordingly, one of the cases, that is, the case in which the holding surface 302 is caused to hold the support component 82 in such a manner that the center of the holding surface 302 is caused to correspond with the center 829 of the support component 82 and the case in which the holding surface 302 is caused to hold the support component 82 in such a manner that the center of the holding surface 302 is caused to correspond with the center 809 of the workpiece 80, can selectively be executed in the holding step, and further, the workpiece 80 can be ground in the grinding step.

The imaging step includes the temporary placement step of temporarily placing the bonded workpiece 8 on the temporary placement table 11 in such a manner that the outer circumference 807 of the workpiece 80 and the outer circumference 828 of the support component 82 are protruded from the temporary placement table 11, as in the imaging step of the first embodiment. In the imaging step, light is emitted from the lower side of the bonded workpiece 8 to the upper side by the illuminator 141 disposed below the bonded workpiece 8 that is temporarily placed, and the bonded workpiece 8 is imaged in such a manner as to include the outer circumference 807 of the workpiece 80 and the outer circumference 828 of the support component 82, by the camera 142 disposed to face the illuminator 141. Therefore, the taken image necessary in the outer circumference recognition step to be executed after the imaging step can easily be acquired.

As in the imaging step of the second embodiment, in the imaging step, the bonded workpiece 8 is imaged by the camera 142, including the outer circumference 807 of the workpiece 80 and the outer circumference 828 of the support component 82 in the bonded workpiece 8 held by the loading arm 52 or the robot 50 of the conveying unit 5 that conveys the bonded workpiece 8 to the holding surface 302. Therefore, the taken image necessary in the outer circumference recognition step to be executed after the imaging step can easily be acquired.

Further, as described above, the grinding apparatus 1 according to the present invention that grinds the bonded workpiece 8 includes the outer circumference recognizing section 90 that, before the bonded workpiece 8 is held by the holding surface 302 of the holding unit 3, distinguishes between the outer circumference 807 of the workpiece 80 and the outer circumference 828 of the support component 82 and recognizes the outer circumferences from a taken image of the bonded workpiece 8 in which the outer circumference 807 of the workpiece 80 and the outer circumference 828 of the support component 82 are included. The grinding apparatus 1 also includes the center recognizing section 92 that recognizes the center 829 of the support component 82 from the outer circumference 828 of the support component 82 recognized by the outer circumference recognizing section 90 and recognizes the center 809 of the workpiece 80 from the outer circumference 807 of the workpiece 80 recognized by the outer circumference recognizing section 90. The grinding apparatus 1 also includes the conveying unit 5 that conveys the bonded workpiece 8 to the holding surface 302 to cause the holding surface 302 to hold the bonded workpiece 8, the setting section 94 that sets whether the center of the holding surface 302 is caused to correspond with the center 829 of the support component 82 or the center of the holding surface 302 is caused to correspond with the center 809 of the workpiece 80 when the holding surface 302 is caused to hold the bonded workpiece 8, and the control unit 9 that controls at least the conveying unit 5 in order to cause the holding surface 302 to hold the bonded workpiece 8 according to the setting of the setting section 94. Therefore, one of the cases, that is, the case in which the holding surface 302 is caused to hold the bonded workpiece 8 in such a manner that the center of the holding surface 302 is caused to correspond with the center 829 of the support component 82 and the case in which the holding surface 302 is caused to hold the bonded workpiece 8 in such a manner that the center of the holding surface 302 is caused to correspond with the center 809 of the workpiece 80, can selectively be executed, and thereafter, the workpiece 80 can be ground.

The mark 825 indicating the crystal orientation of the workpiece 80 is formed in the support component 82, and the holding surface 302 of the holding unit 3 has the same shape as the support component 82 in plan view. The holding unit 3 includes the holding surface rotation unit 36 that rotates the holding surface 302 with the center of the holding surface 302 being the axis. Therefore, the control unit 9 can control the holding surface rotation unit 36 and cause the mark 825 of the support component 82 of the bonded workpiece 8 held by the conveying unit 5 to match the corresponding mark 304 that is formed in the holding surface 302 and corresponds to the mark 825. By executing grinding thereafter, the workpiece 80 can be thinned to even thickness.

It is obvious that the grinding method of a bonded workpiece according to the present invention is not limited to the above-described embodiments and may be carried out in various different forms within the range of the technical idea thereof. Further, the configuration and so forth of the grinding apparatus 1 illustrated in accompanying drawings are also not limited thereto and can be changed as appropriate in a range in which effects of the present invention can be exerted.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding method of a bonded workpiece for grinding a workpiece of the bonded workpiece by an abrasive stone, the bonded workpiece being obtained by bonding at least two transparent components or semitransparent components including the workpiece and a support component to each other, the workpiece being circular plate and being transparent or semitransparent, the support component being circular plate with such a size as to protrude from an outer circumference of the workpiece and being transparent or semitransparent, the grinding method comprising:

an imaging step of imaging the bonded workpiece by a camera in such a manner as to include the outer circumference of the workpiece and an outer circumference of the support component;

an outer circumference recognition step of recognizing each of the outer circumference of the support component and the outer circumference of the workpiece on a basis of a brightness difference between pixels adjacent to each other in a taken image obtained by imaging the bonded workpiece in the imaging step;

a center recognition step of recognizing a center of the support component from the outer circumference of the support component recognized in the outer circumference recognition step and recognizing a center of the workpiece from the outer circumference of the workpiece recognized in the outer circumference recognition step;

a holding step of causing a holding surface of a chuck table to hold the support component of the bonded workpiece after executing the center recognition step; and a grinding step of grinding, by the abrasive stone, the workpiece of the bonded workpiece held in the holding step, wherein the workpiece is ground in the grinding step after one of a case in which the holding surface is caused to hold the support component in such a manner that a center of the holding surface is caused to correspond with the center of the support component or a case in which the holding surface is caused to hold the support component in such a manner that the center of the holding surface is caused to correspond with the center of the workpiece is selectively executed in the holding step.

2. The grinding method of the bonded workpiece according to claim 1, wherein the imaging step includes a temporary placement step of temporarily placing the bonded workpiece on a temporary placement table in such a manner that the outer circumference of the workpiece and the outer circumference of the support component are protruded from the temporary placement table, and in the imaging step, light is emitted from a lower side of the bonded workpiece to an upper side by an illuminator disposed below the bonded workpiece temporarily placed on the temporary placement table, and the bonded workpiece is imaged in such a manner as to include the outer circumference of the workpiece and the outer circumference of the support component, by the camera disposed to face the illuminator.

3. The grinding method of the bonded workpiece according to claim 1, wherein in the imaging step, the bonded workpiece is imaged by the camera in such a manner as to include the outer circumference of the workpiece and the outer circumference of the support component of the bonded workpiece, wherein the bonded workpiece is held by a conveying unit that conveys the bonded workpiece to the holding surface.

4. A grinding apparatus comprising:

a chuck table that holds a support component of a bonded workpiece by a holding surface, the bonded workpiece being obtained by bonding at least two transparent components or semitransparent components including a workpiece and the support component to each other, the workpiece being a circular plate and being transparent or semitransparent, the support component being a circular plate with such a size as to protrude from an outer circumference of the workpiece and being transparent or semitransparent;

a grinding unit that grinds, by an abrasive stone, the workpiece of the bonded workpiece held by the holding surface;

a conveying unit that conveys the bonded workpiece to the holding surface of the chuck table to cause the holding surface to hold the bonded workpiece;

a camera that images the bonded workpiece; and a control unit that controls at least the chuck table, the grinding unit, the conveying unit, and the camera, wherein the control unit includes an outer circumference recognizing section that, before the bonded workpiece is held by the holding surface of the chuck table, distinguishes between the outer circumference of the workpiece and an outer circumference of the support component and recognizes the outer circumferences from a taken image of the bonded workpiece in which the outer circumference of the workpiece and the outer circumference of the support component are included, a center recognizing section that recognizes a center of the support component from the outer circumference of the support component recognized by the outer circumference recognizing section and recognizes a center of the workpiece from the outer circumference of the workpiece recognized by the outer circumference recognizing section, and a setting section that sets whether a center of the holding surface is caused to correspond with the center of the support component or the center of the holding surface is caused to correspond with the center of the workpiece when the holding surface of the chuck table is caused to hold the bonded workpiece, and the control unit controls the conveying unit in order to cause the holding surface of the chuck table to hold the bonded workpiece according to setting of the setting section.

5. The grinding apparatus according to claim 4, wherein the support component has a mark indicating a crystal orientation of the workpiece, the holding surface of the chuck table has a same shape as the support component in plan view, the chuck table includes a holding surface rotation unit that rotates the holding surface with the center of the holding surface being a rotational axis, and the control unit controls the holding surface rotation unit and causes the mark of the support component of the bonded workpiece held by the conveying unit to match a corresponding mark that is formed in the holding surface.

* * * * *